US005956977A

United States Patent [19]

Cotler

[11] Patent Number: 5,956,977

[45] Date of Patent: Sep. 28, 1999

[54] DUST CONTROL AND COOLING APPARATUS FOR CIRCULAR KNITTING MACHINES

[75] Inventor: Elliot M. Cotler, Brooklyn, N.Y.

[73] Assignee: Uniwave, Inc., Farmingdale, N.Y.

[21] Appl. No.: 08/888,313

[22] Filed: Jul. 14, 1997

[51] Int. Cl.[6] ..... D04B 35/32

[52] U.S. Cl. ..... 66/168; 15/301

[58] Field of Search ..... 66/168, 8; 15/300.1, 15/301, 303, 312.1, 312.2, 316.1, 317, 318; 417/472, 474, 423, 475, 478, 479

[56] References Cited

U.S. PATENT DOCUMENTS

| | | | |
|---|---|---|---|
| 2,846,860 | 8/1958 | Shortland | 66/168 |
| 3,220,223 | 11/1965 | Schmidt | 66/168 |
| 3,274,803 | 9/1966 | Schmidt | 66/168 |
| 3,535,895 | 10/1970 | Krauss | 66/168 |
| 4,208,762 | 6/1980 | Starling | 15/312 R |
| 4,718,253 | 1/1988 | Lonati | 66/8 |
| 4,843,843 | 7/1989 | Rovinsky | 66/168 |
| 5,201,793 | 4/1993 | Izumi et al. | 66/168 |
| 5,282,372 | 2/1994 | Gutschmidt | 66/168 |
| 5,379,614 | 1/1995 | Igarashi | 66/168 |
| 5,408,850 | 4/1995 | Kawase et al. | 66/168 |
| 5,737,942 | 4/1998 | Gutschmit | 66/198 |

FOREIGN PATENT DOCUMENTS

| | | | |
|---|---|---|---|
| 0609856 | 8/1994 | European Pat. Off. . | |
| 1635796 | 5/1971 | Germany . | |
| 2126140 | 9/1972 | Germany . | |
| 2448765 | 4/1976 | Germany . | |
| 2708436 | 7/1978 | Germany . | |
| 2815052 | 10/1979 | Germany . | |
| 3305795 | 8/1984 | Germany | 66/168 |
| 3532856 | 12/1986 | Germany . | |
| 4444632 | 6/1996 | Germany . | |
| 9509259 | 4/1995 | WIPO . | |

OTHER PUBLICATIONS

Alandale Industries Inc. brochure, *Filter Flow* 2000, 1996 (2 sheets).

*Primary Examiner*—John J. Calvert
*Assistant Examiner*—Larry D. Worrell, Jr.
*Attorney, Agent, or Firm*—Schweitzer Cornman Gross & Bondell LLP

[57] ABSTRACT

A dust control and cooling apparatus for use in connection with a circular knitting machine includes a flexible manifold which sits upon the knitting machine table and encircles the needle cylinder. A series of nozzles directs pressurized air applied to the manifold towards the needle cylinder to remove lint and dust from the operating surface and cool the components. The manifold assumes a generally flat configuration when not operating, allowing access to the enclosed area without removal of the manifold. When operating the manifold inflates and expands upwardly towards the overlying sinker ring, sealing the enclosed volume and allowing a positive pressure to be generated therein. This positive pressure helps prevent the further ingress of lint and dust into the enclosed volume.

11 Claims, 7 Drawing Sheets

DUST CONTROL AND COOLING APPARATUS FOR CIRCULAR KNITTING MACHINES

The present invention is directed to a new and improved system for the dust control and cooling of circular knitting machines by use of pressurized air.

BACKGROUND OF THE INVENTION

Industrial knitting machines, and particularly circular knitting machines, are of complex, precision construction. They require the attention of skilled operators to ensure that the fabric generated is produced at an optimum rate and is of first quality.

A circular knitting machine includes a plurality of needles arranged in a circular pattern around the perimeter of a cylinder. The needles are provided with yarn. As the cylinder rotates and the needles reciprocate a knitted tubular fabric is developed and is withdrawn from below the needle cylinder.

Because of the constant motion of the needles and associated elements, they must be lubricated and cooled. Physically, such lubrication is provided by an oiling apparatus, the operation of which must be carefully controlled and monitored. Over-lubrication can result in unacceptable fabric spotting and staining, while under-lubrication can result in seizing or jamming of the needles. The importance of adequate heat removal continues to grow as the knitting speed of the machines increases.

The control of dust is another area of concern. The accumulation of dust and lint on or about the needles and associated mechanisms can jam or otherwise disrupt proper operation of the knitting machine. In addition, the capture of lint and dust by the knitted fabric lessens its quality.

Typical dust control apparatus include rotating fans which direct a sweep of air across the knitting machine operating areas. In addition, the use of pressurized air streams and/or suction devices in the proximity of the needle cylinder has been attempted to remove lint and dust from such areas. Such pressurized air devices also serve a cooling function, assisting the lubricating oil in such a regard. Conventional pressurized air and vacuum and suction systems are typically of rigid construction, and either constructed and arranged as an integral part of the knitting machine, or intended to be rigidly fastened and attached thereto. In either case, as a pressure/suction system should surround and enclose the needle cylinder area of the machine to operate effectively, such a system requires mechanical disassembly and removal from the knitting machine for knitting machine maintenance. This represents a significant shortcoming to the use of such systems, as knitting machine operators often require access to the needle area, either to replace a broken needle, restart a broken yarn strand, or otherwise adjust operations. A requirement to disassemble an air supply system to afford access to the knitting machine components blocked thereby, increases the downtime of the knitting machine and can complicate the adjustment or repair process.

It is accordingly a purpose of the present invention to provide a pressurized air cooling and dust control system for a circular knitting machine which may be easily mounted to a knitting machine.

Yet a further purpose of the present invention is to provide an air cooling and dust control system for a circular knitting machine which, when not operating, does not obstruct access to the needle cylinder and dial area.

Still a further purpose of the present invention is to provide a system of the aforementioned type which provides a visual indication of the degree of airflow passing therethrough.

Another purpose of the present invention is to provide a cooling and dust control system of the aforementioned type which can dynamically seal the needle cylinder and dial area of a circular knitting machine when in operation and retract to a rest position when not in use.

BRIEF DESCRIPTION OF THE INVENTION

In accordance with the foregoing and further objects and purposes, a dust control and cooling system for a circular knitting machine constructed in accordance with the present invention comprises a flexible air manifold capable of being placed on a knitting machine table surrounding the needle cylinder and needle cams. A series of nozzles project inwardly from the manifold and are directed towards the cams and cylinder. A source of pressurized air is connected to the manifold. The manifold may be in the form of an inflatable bladder or bellows which, when the air source is not operating, assumes a relatively flat and collapsed configuration. When the air source is activated, the manifold inflates and rises, substantially sealing the area between the table and the overlying sinker ring. The exiting airflow from the nozzles provide a cooling and cleaning flow of air across the needles and cams, while pressurizing the enclosed volume and thus preventing the further ingress of dust and lint therein. When the air source is disconnected the manifold deflates to its collapsed position, allowing access to the needle area without the necessity of disassembly or removal of the manifold. As the extent of manifold expansion is dependent upon the degree of airflow there through, the visual appearance of the manifold serves as a visual indicator of the degree of airflow, allowing operating personnel to confirm that the airflow provided is sufficient.

BRIEF DESCRIPTION OF THE DRAWINGS

A fuller understanding of the present invention will be obtained upon review of the following detailed description of preferred, but nonetheless illustrative embodiments of the invention, when reviewed in association with the annexed drawings, wherein.

DETAILED DESCRIPTION OF THE INVENTION

Figure 1:
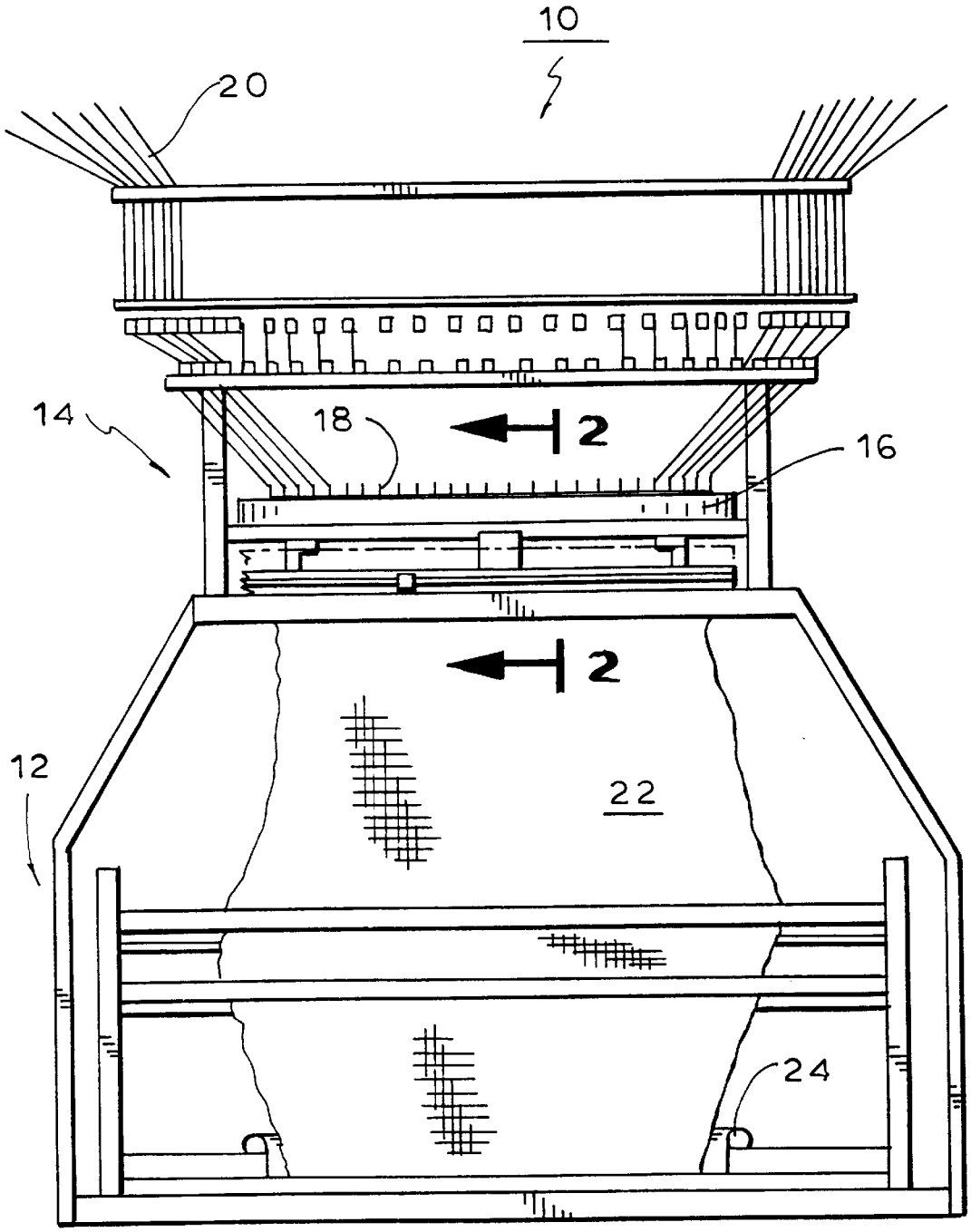
FIG. 1 is an elevation view of a typical single knit circular knitting machine having the present invention installed thereon, it being recognized that such a construction is merely illustrative of the general layout of such machines.
Figure 2:
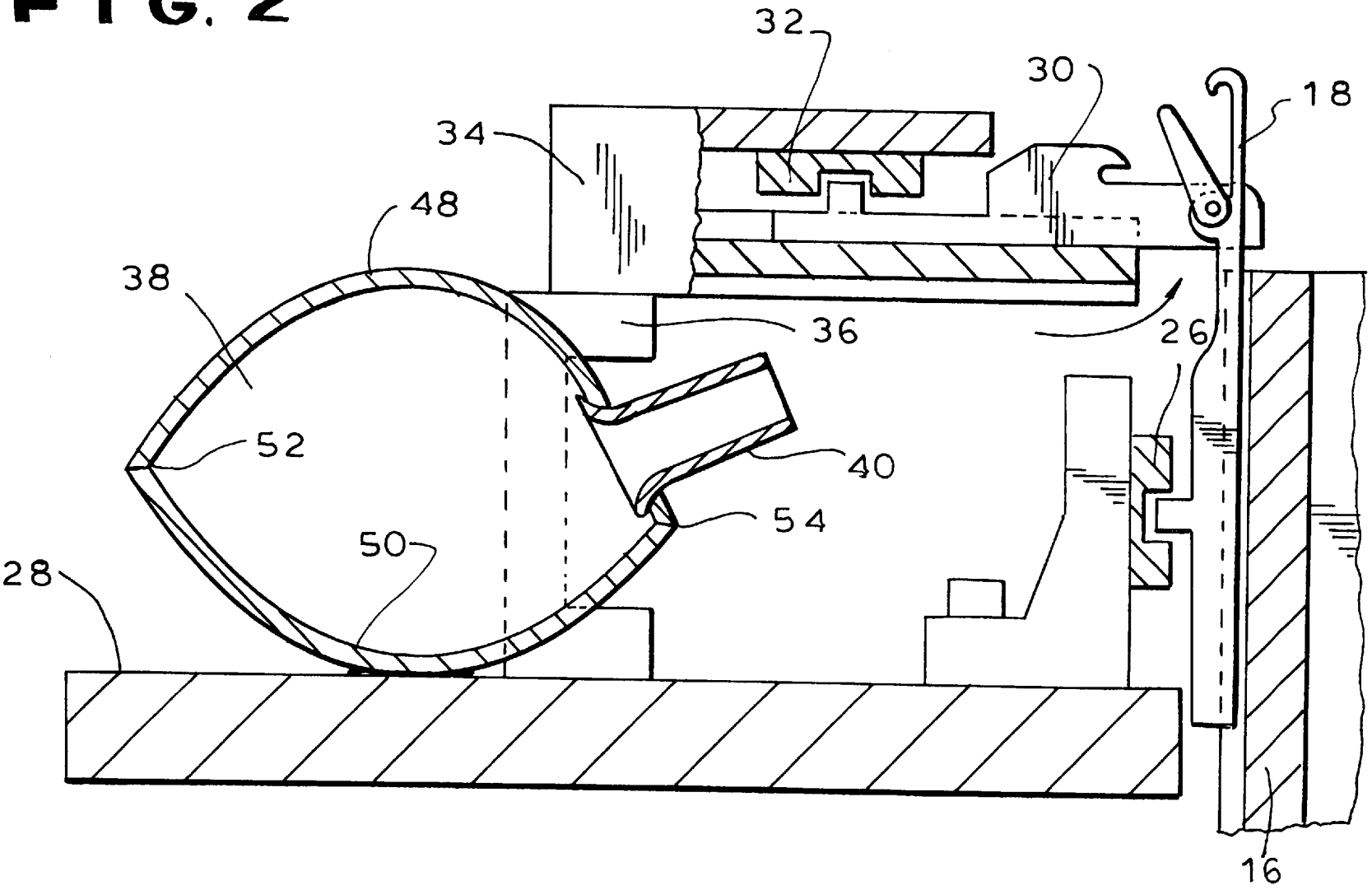
FIG. 2 is a partial elevation view in section taken along line 2—2 of FIG. 1 depicting the needle area of the machine.

With initial reference to FIGS. 1 and 2, circular knitting machine 10 includes a lower frame 12 and an upper frame 14. Needle cylinder 16 supports a plurality of needles 18. Yarn strands 20 are directed to the needles for knitting, the knitted fabric 22 typically being collected on a rotating mandrel 24.

As depicted in FIG. 2 and as known in the art, needle cylinder 16, which supports the needles 18 in vertical slots, rotates, causing the needles to reciprocate through contact with needle cam assembly 26 which is mounted to table 28. Sinkers 30, which are synchronized with the operation of the needles 18, simultaneously reciprocate through contact with fixed sinker cams 32 which are mounted to sinker ring 34 which in turn is supported by spaced uprights 36 above table 28. In a double knit knitting machine, the sinkers are replaced by a second set of needles driven by a needle ring. The simultaneous reciprocating motion of the needles and sinkers, accompanied by the continuous frictional contact between the needles and sinkers and their respective slots and cams, requires continuous lubrication and cooling. In addition, the unwanted ingress of lint, dust and other particles into the mechanism can cause overheating and needle breakage, as well as creating imperfections in the knitted fabric.

Figure 6:
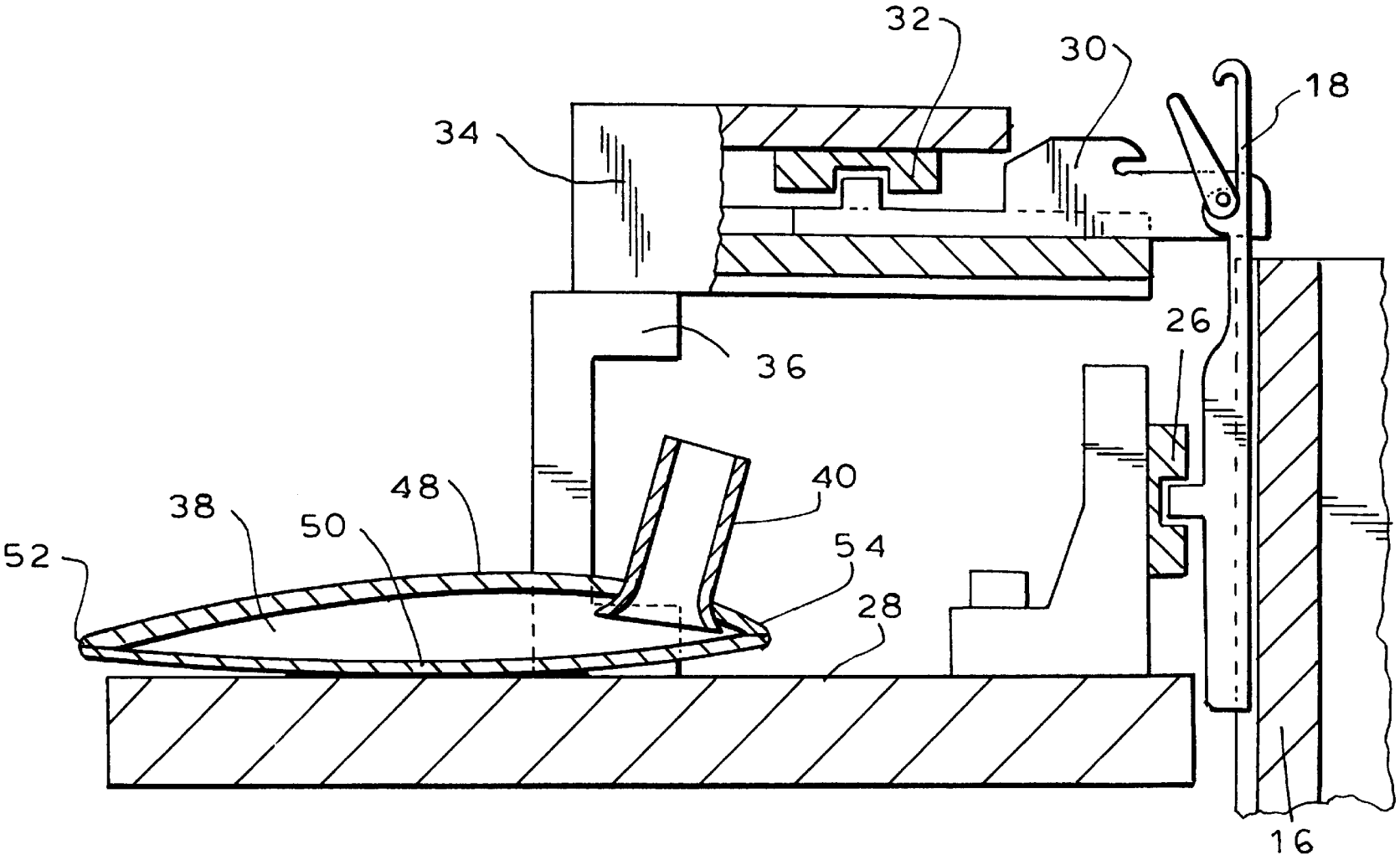
FIG. 6 is a section view similar to that of FIG. 2 depicting the manifold in a deflated condition.

With further initial reference to FIGS. 2 and 6, the present invention comprises the arrangement of a flexible manifold 38 in a circular configuration on table 28, the manifold being supplied with pressurized air which exits the manifold through a plurality of nozzles 40 which direct the air flow radially inwardly towards the needle cylinder. The exiting air flow removes dust and other particles from the area surrounding the needles, sinkers and associated components, and further serves to cool the components, augmenting the cooling provided by a conventional oil lubrication system (not shown).

Figure 3:
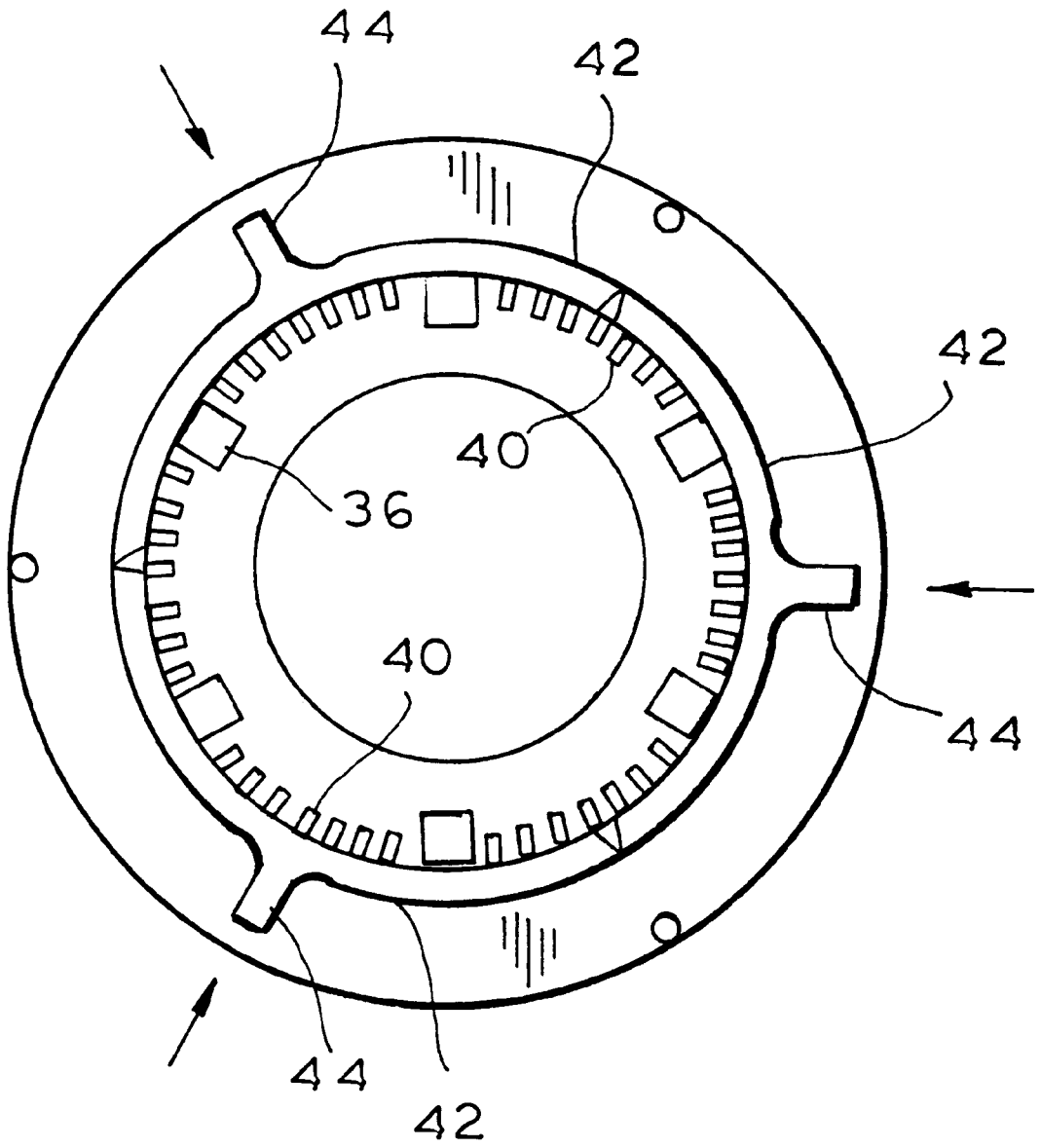
FIG. 3 is a schematicized sectional top plan view depicting an arrangement of the manifold of the present invention on the circular knitting machine.
Figure 4:
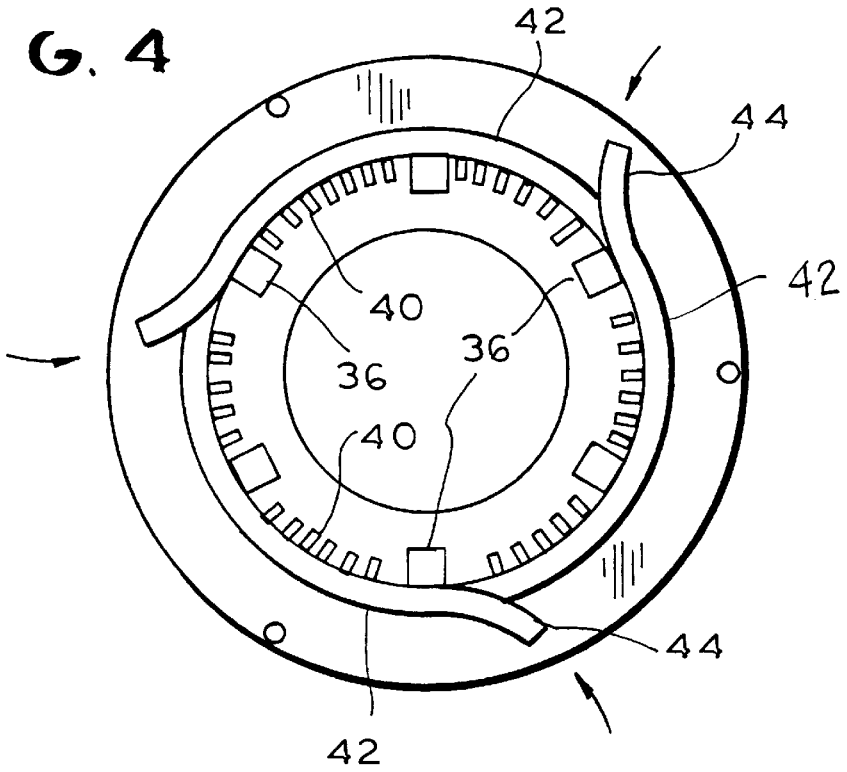
FIG. 4 is a top plan view in section depicting an alternative arrangement of the manifold.
Figure 5:
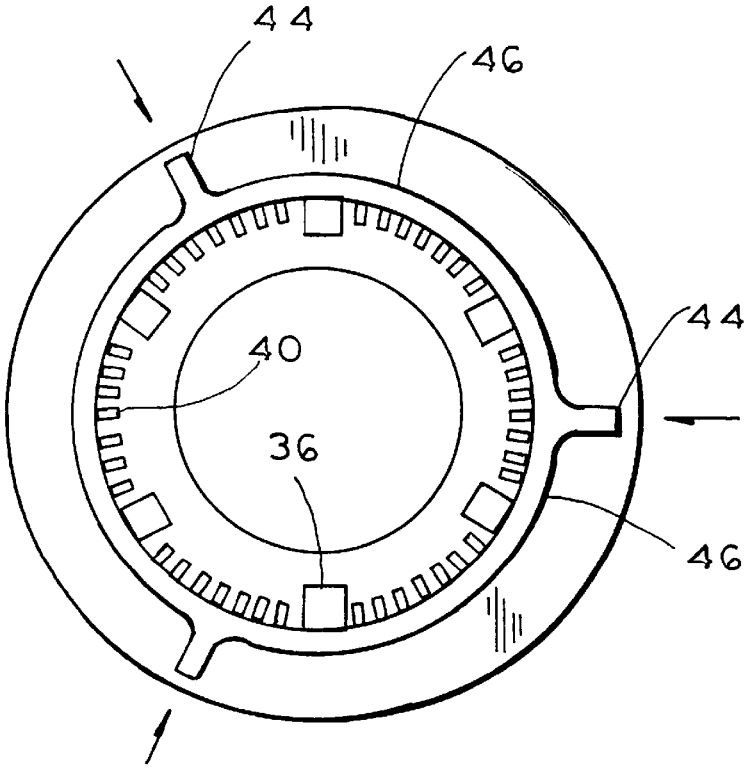
FIG. 5 is a top plan view in section depicting yet another alternative construction for the manifold.

As depicted in FIGS. 3 through 5, the manifold 38 may take a variety of configurations. As shown in FIG. 3, a plurality of individual manifold units 42 may be utilized, each manifold unit having an arcuate shape viewed in plan, the totality of the units fully encircling the needle cylinder. The manifolds may be three in number, each circulating an arc of 120 degrees. Each of the manifolds 42 is provided with a series of nozzles 40, and each manifold includes a centrally located inlet portion 44 to which a source of compressed air is coupled. In FIG. 4 the inlets are located at an end of the manifolds. Elimination of the sharp angle between the inlet portions and the main portions of the manifolds may provide for improved airflow through the manifold.

As depicted in FIG. 5, the manifold 38 may alternatively be formed as a single, continuous ring 46. To minimize pressure gradients about the ring, a plurality of inlets 44 may be used.

A variety of constructions may be utilized for the manifolds. As shown in FIGS. 2 and 6, the manifold may be formed as a single bladder, with top and bottom walls 48, 50 joined together at seams 52, 54. The walls are formed of flexible plastic, as known in the art. Nozzles 40 may be formed of a rigid plastic, and may be mounted in and sealed to appropriately sized apertures formed in the bladder top wall 48. The nozzles are spaced to provide a generally continuous exiting airflow along the length of the manifold. Appropriate gaps may be left in the spacing to allow the manifold to accommodate the sinker ring supports 36.

Because the bladder is formed of a flexible material, it normally lies flat on the table 28, as shown in FIG. 6, with the top and bottom walls in an abutting relationship. In such a condition, essentially unobstructed access is provided to the needle area, thus avoiding the necessity of removal of the manifold units and eliminating the disassembly of alternative rigidly-mounted dust-control units which otherwise semi-permanently block access to the needle area.

When air pressure is applied to the bladder it inflates and assumes a configuration as shown in FIG. 2, the nozzles being oriented inwardly by the rising of the top wall 48 to direct the air flow as required. As may be seen, the inflated bladder substantially spans the distance between the table and the sinker ring 34, thus allowing a volume of increased pressure to be developed radially inwardly of the bladder. This increased pressure is vented substantially between the sinkers as depicted by the arrow, and assists in both removing accumulated dust and lint from the operating areas as well as preventing the ingress of additional lint.

Figure 7:
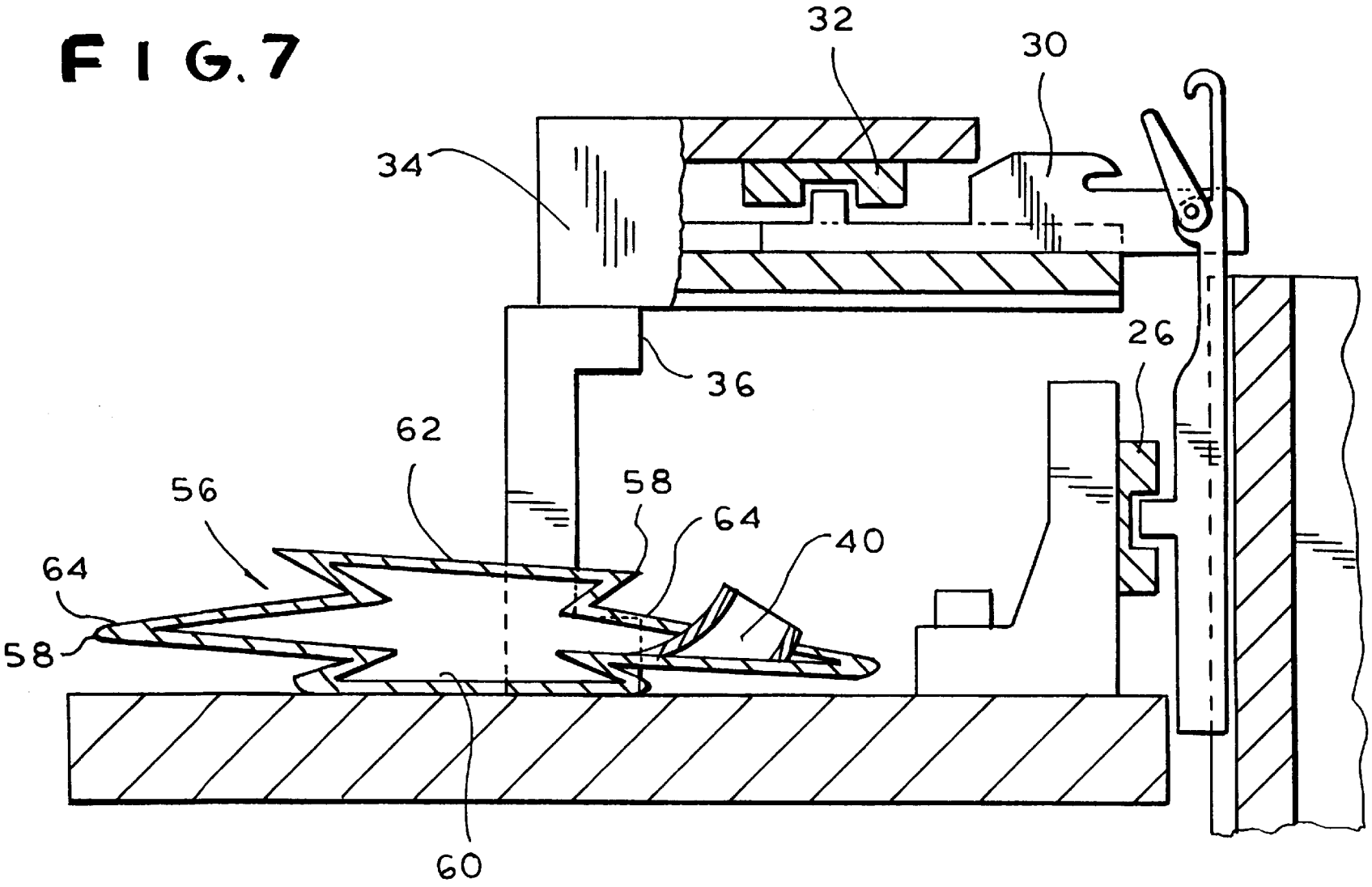
FIG. 7 is a section view similar to FIG. 2 depicting an alternative construction of the manifold in a deflated condition.
Figure 8:
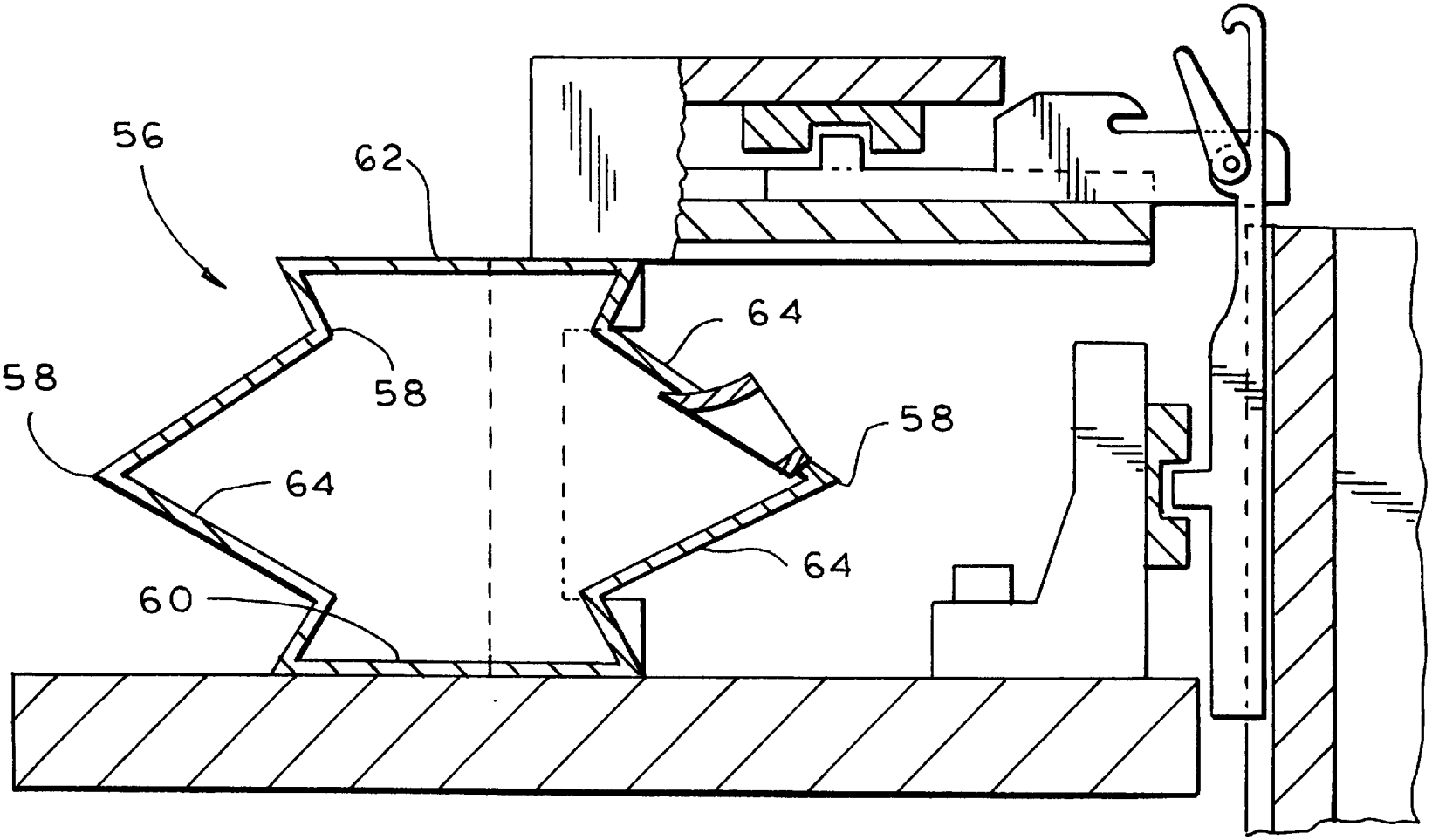
FIG. 8 is a section view depicting the manifold construction of FIG. 7 in an inflated and operating position.

An alternative construction for the manifold is depicted in FIGS. 7 and 8. As shown therein, the manifold may be in the form of a bellows-like construction 56 with pleats or folds 58 in the side walls 64. Such a construction can generate a greater degree of rise than a bladder. In addition, an appropriate choice of size and number of pleats can allow the nozzles, mounted on a pleat, to be aimed with greater precision.

As shown in the Figures, the bellows arrangement may include planar bottom and top surfaces 60, 62. Such a configuration can allow for more effective sealing between the bellows and the table and sinker ring when in the inflated position, as depicted in FIG. 8. Upon deflation, as shown in FIG. 7, however, substantial clearance is again provided for access to the needles without the necessity of removal of the bellows. As with the bladder embodiment, the bellows may be constructed from an appropriate flexible sheet plastic as known in the art.

Because rising of the manifold is contingent upon the provision of a sufficient flow of compressed air, the degree of rise may serve as a visual indication to operating personnel of proper operation. A decreased supply of airflow, such as can result from a clogged air filter, would be reflected by insufficient manifold inflation, thus alerting personnel that compressor operation has been impaired.

With the use of a three-section bladder configuration forming a ring of approximately 24 inches in diameter, bladder sections bearing 20 nozzles each of 0.625 inch inner diameter can generate a sufficient air flow when coupled to blowers having a rated capacity on the order of approximately 185 cubic feet per minute.

It is to be recognized that modification, adaptation and variation to the embodiments of the invention set forth herein can be accomplished without departing from the intended spirit and scope of the invention. Accordingly, the scope of the invention should be measured by the scope of the annexed claims.

I claim:

1. A dust control and cooling apparatus for a circular knitting machine having a table, a needle cylinder located inwardly of the table, and a sinker or needle ring above the table, comprising a flexible manifold adapted and constructed to rest on the table, said manifold having a pressurized air inlet and a plurality of outlet nozzles directed radially inwardly towards said needle cylinder, said manifold assuming a collapsed position upon said table in the absence of pressurization by a pressurized air source, and assuming an inflated position, substantially spanning the distance between the table and the sinker or needle ring when pressurization by the compressed air source is applied to the manifold.

2. The apparatus of claim 1, wherein said manifold is in the form of an inflatable bladder.

3. The apparatus of claim 1, wherein said manifold is in the form of an inflatable bellows.

4. The apparatus of claim 1, wherein said manifold contacts the sinker or needle ring when pressurization is applied.

5. The apparatus of claim 2, wherein said bladder comprises a top wall and a bottom wall, said nozzle being mounted to said top wall.

6. The apparatus of claim 3, wherein said bellows comprises pleated side walls joined to top and bottom walls.

7. The apparatus of claim 6, wherein said nozzles are mounted to one of said pleated side walls.

8. The apparatus to claim 1, wherein the manifold is in the form of a ring encircling said needle cylinder.

9. The apparatus of claim 1, wherein the manifold is in the form of a segment of a ring partially encircling said needle cylinder.

10. The apparatus of claim 9, wherein said inlet is located at an end of the manifold.

11. The apparatus of claim 8, wherein said inlet is located proximate the middle of the manifold.

* * * * *